US006648158B1

(12) United States Patent
Lawrence

(10) Patent No.: US 6,648,158 B1
(45) Date of Patent: Nov. 18, 2003

(54) SELF-CLOSING CAP FOR A BOTTLE

(76) Inventor: Kevin Q. Lawrence, 5135 S. Blackstone, Chicago, IL (US) 60615

( * ) Notice: Subject to any disclaimer, the term of this patent is extended or adjusted under 35 U.S.C. 154(b) by 0 days.

(21) Appl. No.: 10/135,280

(22) Filed: Apr. 29, 2002

(51) Int. Cl.[7] ..... B65D 43/20; B65D 55/16

(52) U.S. Cl. ..... 215/306; 215/322; 220/345.4; 220/348

(58) Field of Search ..... 215/306, 236, 215/258, 322; 220/375, 259.4, 259.5, 345.2, 348, 816, 345.1, 345.4

(56) References Cited

U.S. PATENT DOCUMENTS

| | | | | | |
|---|---|---|---|---|---|
| 423,639 | A | * | 3/1890 | Simon | 215/236 |
| 1,159,552 | A | * | 11/1915 | Truxell | 292/120 |
| 1,905,955 | A | * | 4/1933 | Waehner | 220/814 |
| 2,149,795 | A | * | 3/1939 | Skoblin | 222/512 |
| 2,187,927 | A | | 1/1940 | Ayotte | |
| 2,237,162 | A | * | 4/1941 | Robinson | 434/100 |
| 2,527,191 | A | * | 10/1950 | Lambert | 222/505 |
| 2,588,275 | A | * | 3/1952 | Nadai | 215/306 |
| 2,977,973 | A | * | 4/1961 | Chakine | 137/223 |
| 3,792,803 | A | | 2/1974 | Kessler | |
| 3,938,690 | A | | 2/1976 | Butler | |
| 4,077,537 | A | * | 3/1978 | Libit | 215/253 |
| 4,934,547 | A | * | 6/1990 | Mayes et al. | 215/306 |
| 5,200,153 | A | * | 4/1993 | Carr et al. | 422/102 |
| 5,310,081 | A | | 5/1994 | McCabe | |
| 5,752,612 | A | | 5/1998 | Fritzsche et al. | |
| 5,921,425 | A | | 7/1999 | Markey | |
| 6,145,706 | A | * | 11/2000 | Dinand | 222/182 |
| 6,460,560 | B1 | * | 10/2002 | Weinheimer et al. | 137/232 |

* cited by examiner

*Primary Examiner*—Lee Young
*Assistant Examiner*—Niki M. Eloshway
(74) *Attorney, Agent, or Firm*—Richard L. Miller

(57) ABSTRACT

A self-closing cap for a bottle that includes a fixed portion that engages the neck of the bottle, a movable portion that is movably attached to the fixed portion, and apparatus that movably attaches the movable portion to the fixed portion. The apparatus includes a pair of resilient bands that engage in an aligned pair of throughbores in a pair of tabs of the fixed portion and in a pair of tabs in the movable portion so as to allow the movable portion to return to the closed position thereof when the movable portion is moved to the open position thereof and released.

8 Claims, 1 Drawing Sheet

SELF-CLOSING CAP FOR A BOTTLE

BACKGROUND OF THE INVENTION

1. Field of the Invention

The present invention relates to a cap for a bottle. More particularly, the present invention relates to a self-closing cap for a bottle.

2. Description of the Prior Art

Numerous innovations for caps have been provided in the prior art that will be described. Even though these innovations may be suitable for the specific individual purposes to which they address, however, they differ from the present invention.

A FIRST EXAMPLE, U.S. Pat. No. 2,187,927 to Ayotte teaches a dispensing device comprising a body portion having a flat closure surface and a spout opening therein, a handle associated with said body portion, a horizontally disposed cover plate for said spout opening, said cover plate being pivotally mounted on said flat closure surface and arcuately movable on said flat surface over the top of said spout opening, an actuating member slidably mounted with respect to said body portion and in engagement with said cover plat, spring means for urging said actuating member rearwardly to pivotally move said cover plate over the top of said spout opening to close said spout opening, said handle adapted to be grasped by the hand and the actuating member adapted to be pushed forwardly by the thumb to cause said cover plate to move in an arcuate direction to uncover the top of said spout opening.

A SECOND EXAMPLE, U.S. Pat. No. 3,792,803 to Kessler teaches a self-reclosing cap, preferably of plastic which has a pouring aperture access to the contents of a bottle or other container with which the cap is used, and a sliding cover for the aperture which cover is normally closed by elastic cord and can be slid back by the user against the tension of the elastic cord to uncover the aperture.

A THIRD EXAMPLE, U.S. Pat. No. 3,938,690 to Butler teaches a cover that is mounted in a leakproof manner over the open mouth of a drinking container. An opening is formed through the cover in the area of the circumference of the cover. A closure member is slidably mounted on the cover for movement over the opening whereby the container is rendered spill-proof and for movement to a position free from the opening whereby a user may pour and drink liquid in the container through the opening in the cup.

A FOURTH EXAMPLE, U.S. Pat. No. 5,310,081 to McCabe teaches an integral beverage can closure embodiment having a sealed position for sealing the contents of an opened beverage can and a dispensing position for dispensing the content is disclosed. A resilient cap with a skirt closely fits over the can rim. The cap defines a tongue that folds over a hinge and is inserted in a slot of the skirt. Both the tongue and the cap have dispensing apertures and vents. When the apertures and vents align, the beverage may be dispensed. The can is sealed when the apertures and vents are displaced. The tongue is caused to move between the sealed and dispensing positions by pressing down, with a finger or thumb of the hand holding the can, on a knurled portion of the tongue. In an embodiment, the tongue defines a lever configured to be spaced from the beverage can to facilitate gripping the can and lever together. Applying force to the lever moves the tongue between sealed and dispensing positions.

A FIFTH EXAMPLE, U.S. Pat. No. 5,752,612 to Fritzsche et al. teaches a closure for a container that comprises a slidable opening member slidable between a retracted position and an extended position. In the retracted position, substantially no opening force can readily be applied to the opening member. In the extended position, an opening force can be applied to the opening member to open the container. A spring or similar device is provided for automatically returning the opening member to the retracted position.

A SIXTH EXAMPLE, U.S. Pat. No. 5,921,425 to Markey teaches a container cap for safely dispensing material from a container, especially cleanser containers. The device includes a circular cap member having an apertured top wall and a cylindrical collar adapted to engage with the top of a container, a pivoting disk attached to the top wall for pivoting movement to selectively cover and uncover the aperture(s) in the top wall, and a finger actuated, spring biased tab connected to the disk to cause pivoting movement of the disk between the covered and uncovered positions. A cylindrical containment tube extends from the top wall inside the cap member which seals with the top of the container. The material within the container thus flows entirely through the containment tube to the aperture(s), before being dispensed from the cap.

It is apparent that numerous innovations for caps have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a self-closing cap for a bottle that avoids the disadvantages of the prior art.

ANOTHER OBJECT of the present invention is to provide a self-closing cap for a bottle that is simple and inexpensive to manufacture.

STILL ANOTHER OBJECT of the present invention is to provide a self-closing cap for a bottle that is simple to use.

BRIEFLY STATED, STILL YET ANOTHER OBJECT of the present invention is to provide a self-closing cap for a bottle that includes a fixed portion that engages the neck of the bottle, a movable portion that is movably attached to the fixed portion, and apparatus that movably attaches the movable portion to the fixed portion. The apparatus includes a pair of resilient bands that engage in an aligned pair of throughbores in a pair of tabs of the fixed portion and in a pair of tabs in the movable portion so as to allow the movable portion to return to the closed position thereof when the movable portion is moved to the open position thereof and released.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Figure 1:
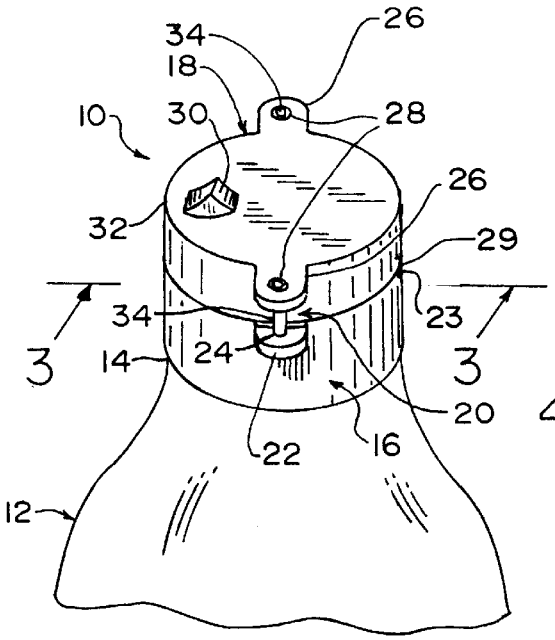
FIG. 1 is a diagrammatic perspective view of the present invention in use and in the closed position.
Figure 2:
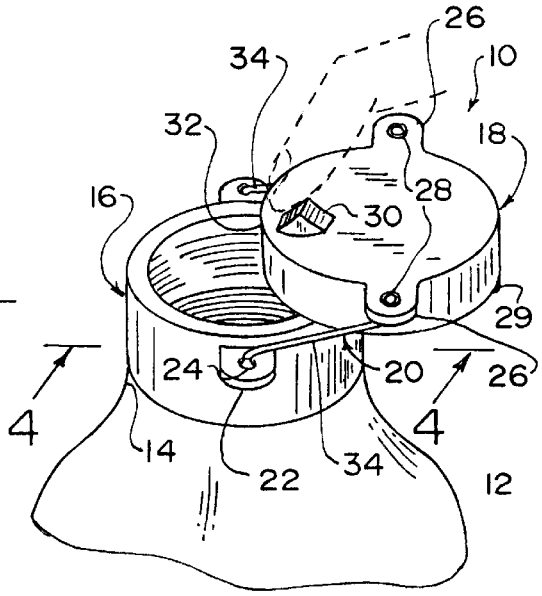
FIG. 2 is a diagrammatic perspective view of the present invention in use and in the open position.
Figure 3:
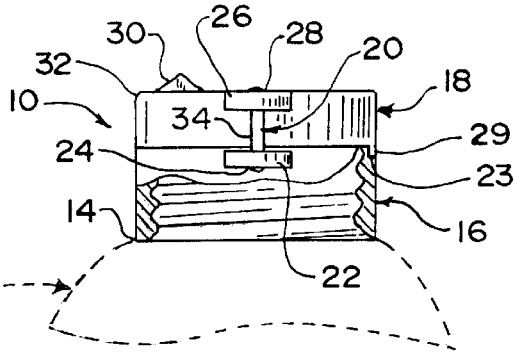
FIG. 3 is a diagrammatic cross sectional view taken along line 3—3 in FIG. 1.
Figure 4:
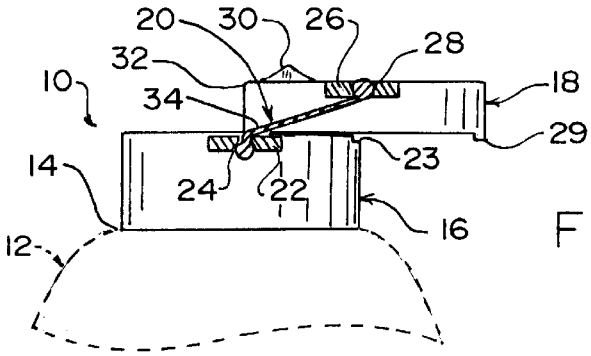
FIG. 4 is a diagrammatic cross sectional view taken along line 4—4 in FIG. 2.

10 self-closing cap of present invention for bottle 12
12 bottle
14 neck of bottle 12
16 fixed portion for engaging neck 14 of bottle 12
18 movable portion
20 apparatus
22 pair of tabs of fixed portion 16
23 notch in fixed portion 16
24 pair of throughbores through pair of tabs 22 of fixed portion 16, respectively
26 pair of tabs of movable portion 18
28 pair of throughbores through pair of tabs 26 of movable portion 18, respectively
29 leg of movable portion 18
30 protrusion of movable portion 18
32 outermost periphery of movable portion 18
34 pair of resilient bands of apparatus 20

DETAILED DESCRIPTION OF THE PREFERRED EMBODIMENT

Referring now to the figures, in which like numerals indicate like parts, the self-closing cap of the present invention is shown generally at 10 for a bottle 12, wherein the bottle 12 has a neck 14 that is externally threaded.

The self-closing cap 10 comprises a fixed portion 16 for engaging the neck 14 of the bottle 12, a movable portion 18 that is movably attached to the fixed portion 16, and apparatus 20 that movably attaches the movable portion 18 to the fixed portion 16.

The fixed portion 16 is tubular, open-ended, and internally threaded for threadably engaging the neck 14 of the bottle 12.

The fixed portion 16 has a pair of tabs 22 that extend radially outwardly from diametrically opposing sides thereof, and which have a pair of throughbores 24 therethrough, respectively.

The fixed portion 16 has a notch 23 therein that is disposed intermediate the pair of tabs 22 thereof, at an uppermost and outermost periphery thereof.

The movable portion 18 is tubular, and has a closed position in which the fixed portion 16 and the neck 14 of the bottle are closed and an open position in which the fixed portion 16 and the neck 14 of the bottle 12 are open.

The movable portion 18 has a pair of tabs 26 that extend radially outwardly from diametrically opposing sides thereof, are aligned with the pair of tabs 22 of the fixed portion 16 when the movable portion 18 is in the closed position thereof, and have a pair of throughbores 28 therethrough, respectively.

The movable portion 18 has a leg 29 that depends therefrom and is disposed intermediate the pair of tabs 26 thereof, at an lowermost and outermost periphery thereof, and engages the notch 23 in the fixed portion when the movable portion 20 is in the closed position thereof.

The movable portion 18 further has a protrusion 30 that extends upwardly therefrom, and which is disposed intermediate the pair of tabs 26 thereof, at an uppermost and outermost periphery 32 thereof, opposite the leg 29 thereof.

The apparatus 20 comprises a pair of resilient bands 34, each of which engages through an aligned pair of the throughbores 24 in the pair of tabs 22 of the fixed portion 16 and the throughbores 28 in the pair of tabs 26 in the movable portion 18 so as to allow the movable portion 18 to return to the closed position thereof when the movable portion 18 is moved to the open position thereof by pulling on the protrusion 30 thereof and released, with the leg 29 of the movable portion 18 engaging the notch 23 in the fixed portion 16 forming a stop.

It will be understood that each of the elements described above, or two or more together, may also find a useful application in other types of constructions differing from the types described above.

While the invention has been illustrated and described as embodied in a self-closing cap for a bottle, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A self-closing cap for a bottle, wherein the bottle has a neck that is externally threaded, said cap comprising:

a) a fixed portion;

b) a movable portion; and c) apparatus;

wherein said fixed portion is for engaging the neck of the bottle;

wherein said movable portion is movably attached to said fixed portion; and wherein said apparatus movably attaches said movable portion to said fixed portion, wherein said fixed portion has a pair of tabs; and wherein said pair of tabs of said fixed portion extend radially outwardly from diametrically opposing sides thereof, wherein said pair of tabs of said fixed portion have a pair of throughbores therethrough, respectively, wherein said fixed portion has a notch therein;

wherein said notch in said fixed portion is disposed intermediate said pair of tabs thereof; and wherein said notch in said fixed portion is disposed at an uppermost and outermost periphery thereof, wherein said movable portion has a pair of tabs;

wherein said pair of tabs of said movable portion extend radially outwardly from diametrically opposing sides thereof; and wherein said pair of tabs of said movable portion are aligned with said pair of tabs of said fixed portion when said movable portion is in said closed position thereof, wherein said lair of tabs of said movable portion have a pair of throughbores therethrough, respectively, wherein said movable portion has a leg;

wherein said leg of said movable portion depends therefrom;

wherein said leg of said movable portion is disposed intermediate said pair of tabs thereof;

wherein said leg of said movable portion is disposed at a lowermost and outermost periphery thereof; and wherein said leg of said movable portion engages said notch in said fixed portion when said movable portion is in said closed position thereof.

2. The cap as defined in claim 1, wherein said fixed portion is tubular.

3. The cap as defined in claim 1, wherein said fixed portion is open-ended.

4. The cap as defined in claim 1, wherein said fixed portion is internally threaded for threadably engaging the neck of the bottle.

5. The cap as defined in claim 1, wherein said movable portion is tubular.

6. The cap as defined in claim 1, wherein said movable portion has a closed position in which said fixed portion and the neck of the bottle are closed; and wherein said movable portion has an open position in which said fixed portion and the neck of the bottle are open.

7. The cap as defined in claim 1, wherein said movable portion has a protrusion;

wherein said protrusion of said movable portion extends upwardly therefrom;

wherein said protrusion of said movable portion is disposed intermediate said pair of tabs thereof;

wherein said protrusion of said movable portion is disposed at an uppermost and outermost periphery thereof; and wherein said protrusion of said movable portion is disposed opposite said leg thereof.

8. The cap as defined in claim 7, wherein said apparatus comprises a pair of resilient bands; and wherein each resilient band engages through an aligned pair of said throughbores in said pair of tabs of said fixed portion and said throughbores in said pair of tabs in said movable portion so as to allow said movable portion to return to said closed position thereof when said movable portion is moved to said open position thereof by pulling on said protrusion thereof and released, with said leg of said movable portion engaging said notch in said fixed portion forming a stop.

* * * * *